US009404720B2

(12) United States Patent
Pedersen

(10) Patent No.: US 9,404,720 B2
(45) **Date of Patent: *Aug. 2, 2016**

(54) SELF CENTERING NOCK

(71) Applicant: Out RAGE, LLC, Cartersville, GA (US)

(72) Inventor: William E. Pedersen, Duluth, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/559,130

(22) Filed: Dec. 3, 2014

(65) Prior Publication Data

US 2015/0087451 A1 Mar. 26, 2015

Related U.S. Application Data

(63) Continuation of application No. 13/785,862, filed on Mar. 5, 2013, now Pat. No. 9,028,347.

(60) Provisional application No. 61/621,211, filed on Apr. 6, 2012.

(51) Int. Cl.
*F42B 6/06* (2006.01)
*F21V 33/00* (2006.01)

(52) U.S. Cl.
CPC ..... *F42B 6/06* (2013.01); *F21V 33/008* (2013.01)

(58) Field of Classification Search
CPC ..... F42B 6/06; F42B 6/08
See application file for complete search history.

(56) References Cited

U.S. PATENT DOCUMENTS

| | | | |
|---|---|---|---|
| 2,484,589 | A | 10/1949 | Richards |
| 2,887,319 | A | 5/1959 | Lay |
| 4,003,576 | A | 1/1977 | Carella |
| 4,305,588 | A | 12/1981 | Dodge |
| 4,340,930 | A | 7/1982 | Carissimi |
| 4,547,837 | A | 10/1985 | Bennett |
| 4,645,211 | A | 2/1987 | Beiter |
| D301,272 | S | 5/1989 | Barrow et al. |
| 4,856,792 | A | 8/1989 | Hardison |
| 4,900,037 | A | 2/1990 | Miller |
| 5,134,552 | A | 7/1992 | Call et al. |
| 5,154,432 | A | 10/1992 | Saunders |
| 5,306,020 | A | 4/1994 | Bolf |

(Continued)

FOREIGN PATENT DOCUMENTS

| | | | |
|---|---|---|---|
| FR | 2777647 | A1 | 10/1999 |
| GB | 2320207 | A | 6/1998 |

OTHER PUBLICATIONS

Archery Talk—Archers Helping Archers Forum: "Homemade Stuff?", http://www.archerytalk.com/vb/showthread.php?t=201870&page=48&p=5786267 (2007).

Archery Talk—Archers Helping Archers Forum: "Homemade Stuff?", http://www.archerytalk.com/vb/showthread.php?t=201870&page=48&p=5791405 (2007).

(Continued)

*Primary Examiner* — John Ricci

(74) *Attorney, Agent, or Firm* — Covington & Burling LLP; Gregory S. Discher; Grant D. Johnson

(57) ABSTRACT

A self-centering nock is provided for use in a well-balanced nock-arrow or nock-bolt assembly. The self-centering nock includes compliant projecting protrusions or compliant arms that are substantially rotationally symmetric about a cross section normal to a main axis of the self-centering nock. The compliant projecting protrusions or compliant arms may be received in bolts that have bores of differing internal dimensions.

6 Claims, 8 Drawing Sheets

(56) References Cited

U.S. PATENT DOCUMENTS

| | | | | |
|---|---|---|---|---|
| 5,516,857 | A | 5/1996 | Mann | |
| 5,688,890 | A | 11/1997 | Ishiguro et al. | |
| 5,959,059 | A | 9/1999 | Vedula et al. | |
| 6,123,631 | A | 9/2000 | Ginder | |
| 6,364,499 | B1 | 4/2002 | Jones | |
| 6,390,642 | B1 | 5/2002 | Simonton | |
| 6,695,727 | B1 | 2/2004 | Kuhn | |
| 6,736,742 | B2 | 5/2004 | Price et al. | |
| 7,021,784 | B2 | 4/2006 | DiCarlo | |
| 7,189,170 | B1 | 3/2007 | Korsa et al. | |
| 7,211,011 | B1 | 5/2007 | Sutherland | |
| 7,374,504 | B2 | 5/2008 | Palomaki et al. | |
| 7,837,580 | B2 | 11/2010 | Huang et al. | |
| 7,862,457 | B1 | 1/2011 | Urcheck | |
| 7,922,609 | B1 | 4/2011 | Hajari | |
| 7,927,240 | B2 | 4/2011 | Lynch | |
| 7,931,550 | B2 | 4/2011 | Lynch | |
| 7,993,224 | B2 | 8/2011 | Brywig | |
| 8,123,636 | B1 | 2/2012 | Temprine | |
| D664,625 | S | 7/2012 | Minica | |
| 8,257,208 | B2 | 9/2012 | Harding | |
| D669,955 | S | 10/2012 | Minica | |
| D669,956 | S | 10/2012 | Minica | |
| 8,342,990 | B1 | 1/2013 | Price | |
| 8,540,594 | B2 | 9/2013 | Chu | |
| 8,622,855 | B2 | 1/2014 | Bednar et al. | |
| 8,758,177 | B2 | 6/2014 | Minica | |
| 8,795,109 | B2 | 8/2014 | Roman | |
| 8,845,464 | B1 | 9/2014 | Hyde | |
| 8,944,944 | B2 | 2/2015 | Pedersen et al. | |
| 9,028,347 | B2 * | 5/2015 | Pedersen | F42B 6/06 473/578 |
| 2002/0039939 | A1 | 4/2002 | Hartman | |
| 2003/0166425 | A1 | 9/2003 | Sutherland et al. | |
| 2009/0097239 | A1 | 4/2009 | Lynch | |
| 2012/0100942 | A1 | 4/2012 | Minica | |
| 2013/0267359 | A1 | 10/2013 | Pedersen | |
| 2014/0187362 | A1 | 7/2014 | Pedersen et al. | |

OTHER PUBLICATIONS

Archery Talk—Archers Helping Archers Forum: "Homemade Stuff?", http://www.archerytalk.com/vb/showthread.php?t=201870&page=62&p=1056170361 (2009).

PCT International Search Report (PCT Article 18 and Rules 43 and 44) for PCT/US2013/076108, Mar. 13, 2014.

PCT Written Opinion of the International Searching Authority (PCT Rule 43*bis*.1) for PCT/US2013/076108, Mar. 13, 2014.

International Search Report from PCT/US2014/059723, Dec. 22, 2014.

Written Opinion of the International Search Authority from PCT/US2014/059723, Dec. 22, 2014.

International Search Report from PCT/US2014/059742, Dec. 22, 2014.

Written Opinion of the International Search Authority from PCT/US2014/059742, Dec. 22, 2014.

Donald J. Ersler, Letter to Gregory S. Discher and five pages of attached text and images, "Re: U.S. Appl. No. 14/147,043" (Jan. 27, 2015).

"ttown", Archery Talk—Archers Helping Archers Forum: "Homemade Stuff?", http://www.archerytalk.com/vb/showthread.php?t=201870&page=48&p=5791405#post5791405 (website displays "Dec. 4, 2007" (not shown on Cite No. CB), but Cite No. CB document is stamped "Oct. 23, 2014 12:21 PM").

(Author unknown), Description of Bohning Blazer Double Lock Nock® and screenshot of http://www.archerytalk.com/vb/showthread.php?t=201870&page=61&p=1056154584#post1056154584 (description appears to be undated, but screenshot displays "Nov. 17, 2009").

Higher resolution version of screenshot contained in Cite No. CC of http://www.archerytalk.com/vb/showthread.php?t=201870&page=61&p=1056154584#post1056154584 (screenshot displays "Nov. 17, 2009").

"ToxArch1", Archery Talk—Archers Helping Archers Forum: "Homemade Stuff?", http://www.archerytalk.com/vb/showthread.php?t=201870&page=62&p=1056170361#post1056170361 (website displays "Nov. 18, 2009" (not shown on Cite No. CC), but Cite No. CC document is stamped "Jan. 23, 2015 10:03 AM").

* cited by examiner

SELF CENTERING NOCK

CROSS-REFERENCE TO RELATED APPLICATIONS

This application is a continuation, and claims the benefit under 35 U.S.C. §120, of U.S. patent application Ser. No. 13/785,862, filed Mar. 5, 2013, which claims the benefit under 35 U.S.C. §119(e) of U.S. Provisional Patent Application No. 61/621,211, filed Apr. 6, 2012, each of which is herein incorporated by reference in its entirety.

FIELD OF EMBODIMENTS OF THE INVENTION

Embodiments of the present invention generally relate to a nock for an arrow or crossbow bolt, and more specifically to a self-centering nock that is adapted for use with arrows or crossbow bolts of differing internal dimensions, and whose use results in arrow or crossbow bolts that are properly balanced.

BACKGROUND OF EMBODIMENTS OF THE INVENTION

Existing arrows and crossbow bolts (collectively, "bolt" or "bolts") are usually offered in a variety of differing dimensions. Such bolts are often configured with a bore at the distal end of the bolt shaft that is adapted to receive a nock. Bolts are usually made available in different sizes and shapes; for that reason, the dimensions of the internal bore of each bolt into which a nock may be fitted may differ from those of other bolts. As such, each bolt of a specific dimension generally requires a corresponding nock that is dimensioned so that it is properly received into the bolt bore, and whose insertion into the bore results in a properly balanced bolt.

The design, manufacture and marketing of nocks of differing sizes to accommodate differently dimensioned bolts of, for example, a product line, is inefficient, expensive and time-consuming. There is thus a need for a nock that may be used with bolts of differing dimensions, but that results in a properly balanced bolt when used with each differently dimensioned bolt.

SUMMARY OF EMBODIMENTS OF THE INVENTION

In one embodiment of the present invention, a self-centering nock for attachment to a bolt is provided. The self-centering nock includes an intermediate portion and a distal portion. The intermediate portion includes compressible, elastic and/or viscoelastic compliant arms that project from the surface of the intermediate portion, are substantially rotationally symmetric along cross sections normal to the main axis of the nock. The intermediate portion, along with the compliant arms, may be received into bores of bolts of differing dimensions. When so received, compression of the compliant arms by the inner surface of the bore provides a symmetric and self-centering friction fit that secures the nock to the bolt. The self-centering nock may also include a proximal end that is also part of the portion of the nock that is intended for insertion within the bore of a bolt. As used herein, the terms "compression," "compression of," "compressible," "compressed," and the like, do not necessarily mean that there will be a change (e.g., decrease) in volume. Rather, these terms more generically indicate that a force will be exerted on or with respect to, for example, the compliant arms, which may or may not result in a corresponding decrease in volume. Generally, the compressible, elastic and/or viscoelastic elements of the present specification are intended to be structurally deformed with a high likelihood of returning to their original shape.

In another embodiment, compressible, elastic and/or viscoelastic projecting protrusions such as elastomer ribs or projecting protrusions may be formed (for example, through co-molding) on the intermediate portion. The projecting protrusions, when compressed during insertion of the intermediate portion into bores of differently dimensioned bolts, provide a symmetric and self-centering friction fit that serves as a means of attachment of the nock to the bolts.

In another embodiment, hot-melt glue may be applied to the compliant arms or projecting protrusions, which may be used to secure the nock to the bolt. Nocks in embodiments of the present invention may be lighted nocks or nocks without any light. In yet other embodiments, the projecting protrusions may be formed on the inner surface of the bore of a bolt. In this configuration, when the intermediate portion of a nock without any projecting protrusions is inserted into the bore of the bolt, the projecting protrusions provide a self-centering friction fit that serves as a means of attachment of the nock to the bolts. In yet other embodiments, the nock may contain a bore into which the distal end of the bolt fits, with projecting protrusions either on the inner surface of the bore of the nock or on the distal end of the bolt. In these embodiments, the substantial rotational symmetry of the projecting protrusions along cross sections normal to the axis of the bolt provides a self-centering fit and a well-balanced bolt-nock assembly as discussed above.

DESCRIPTION OF EMBODIMENTS OF THE INVENTION

Figure 1A:
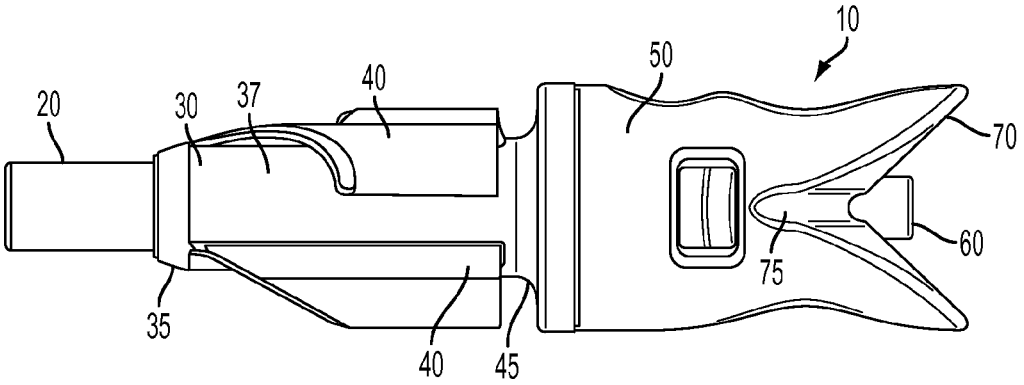
FIG. 1A is an exemplary side view of an embodiment of a self-centering nock, known as the "Half-moon" style nock, that has compliant arms that bend rotationally around the part axis to account for different bolt internal diameters.
Figure 1B:
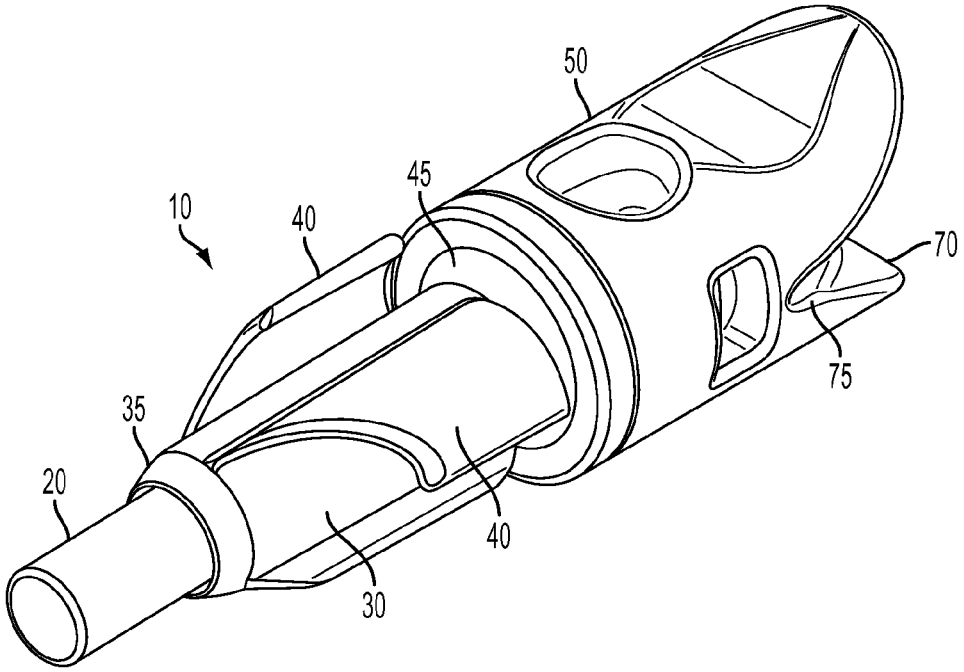
FIG. 1B is an exemplary perspective view of the embodiment of the self-centering nock depicted in FIG. 1A.

FIG. 1 is a side view of an exemplary self-centering nock 10 that may be used with bolts of differing dimensions. The bolts may in particular have bores of differing dimensions that may each receive nock 10. Nock 10 includes three sections: a proximal end 20, an intermediate portion 30 contiguous with proximal end 20, and distal end 50 that is contiguous with intermediate portion 30. In this embodiment, proximal end 20 is of cylindrical shape and has a diameter that is smaller than the diameters of each of the cylinder-like intermediate portion 30 and distal end 50. In one embodiment, proximal end 20 is a battery that is used to power a light source of the nock 10.

Figure 2:
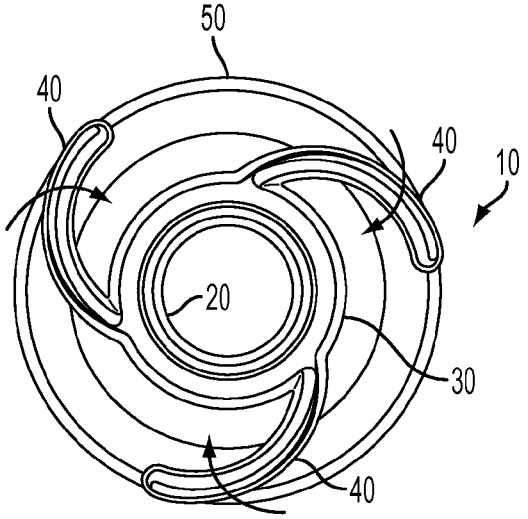
FIG. 2 is an exemplary frontal view of the embodiment of the self-centering nock of FIGS. 1A and 1B that depicts how the compliant arms are free to rotationally bend inward to account for different bolt internal diameters.

In this embodiment, intermediate portion 30 includes a cylindrical portion 37, a proximal portion 35, a distal portion 45 and compliant arms 40. Proximal portion 35 is tapered and has a cross-sectional diameter that varies from a value that is approximately equal to the diameter of proximal end 20 to a value that is approximately equal to the diameter of cylindrical portion 37. Distal portion 45 is flared in the direction of the main axis of the nock, such that the cross sectional diameter of distal portion 45 increases in the direction along the main axis towards distal end 50, and approaches the diameter of distal end 50 where distal portion 45 meets distal end 50. Compliant arms 40 project from the surface of cylindrical portion 37, and as illustrated in the cross-sectional view of FIG. 2, are substantially rotationally symmetric along cross sections normal to the main axis of nock 10. In other words, rotation about the main axis by at least one angle greater than 0 degrees but less than 360 degrees will substantially map the original cross sectional cut on to itself. In an aspect of this embodiment, compliant arms 40 are arranged in a spiral configuration, as illustrated in FIGS. 1-3.

Figure 3:
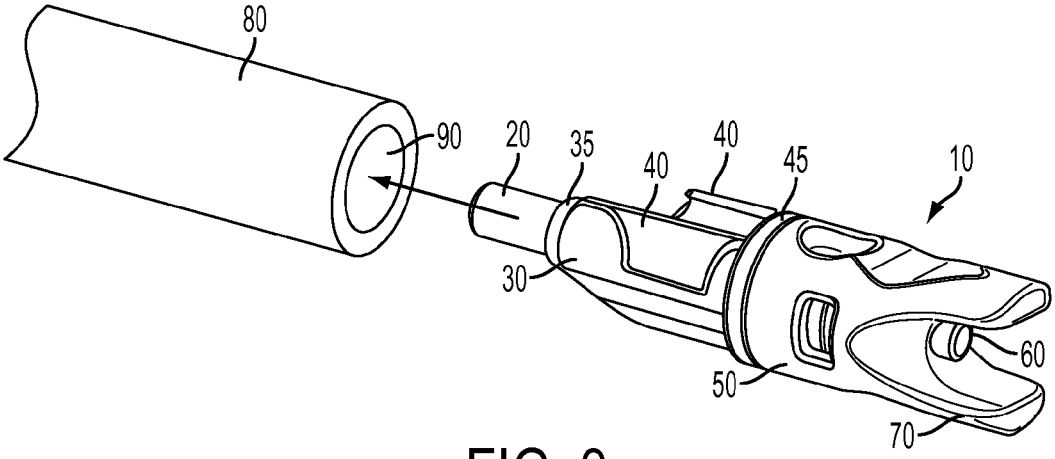
FIG. 3 is an exemplary perspective view of an embodiment of the self-centering nock of FIGS. 1-2 in which insertion of the self-centering nock into the bore of a bolt is also depicted.
Figure 4:
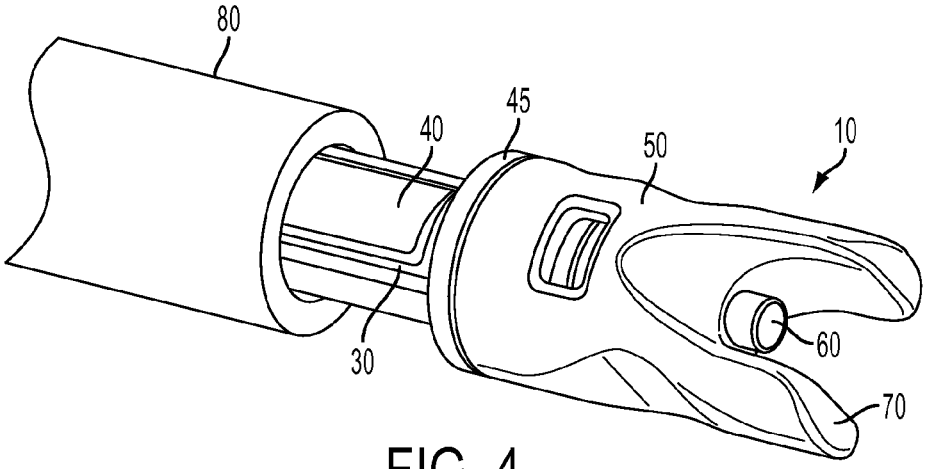
FIG. 4 is an exemplary perspective view of the embodiment of the self-centering nock of FIGS. 1-3 in which the self-centering nock has been partially inserted into the bore of a bolt, and which also depicts how the compliant arms bend toward the part axis to allow for variable bolt internal diameters.
Figure 5A:
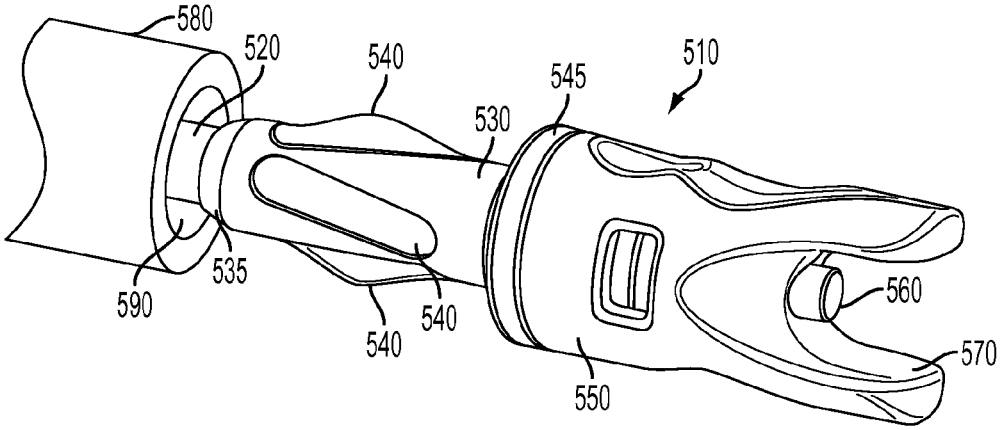
FIG. 5A is an exemplary perspective view of an embodiment of a self-centering nock that has elastomer ribs co-molded on a rigid polymer substrate, and which is illustrated as being partially inserted into the bore of a bolt.
Figure 5B:
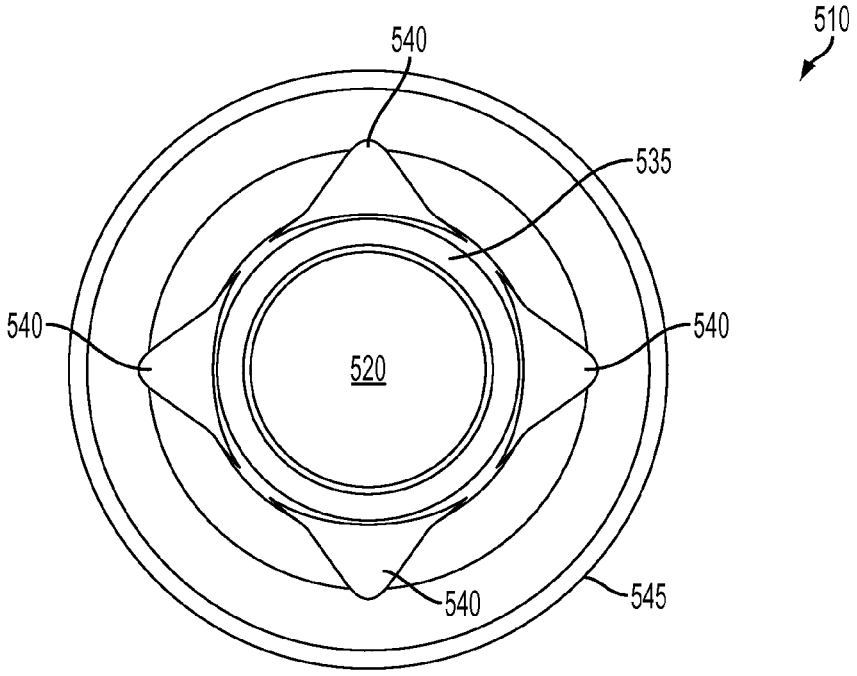
FIG. 5B is an exemplary frontal view of an embodiment of the self-centering nock of FIG. 5A.
Figure 5C:
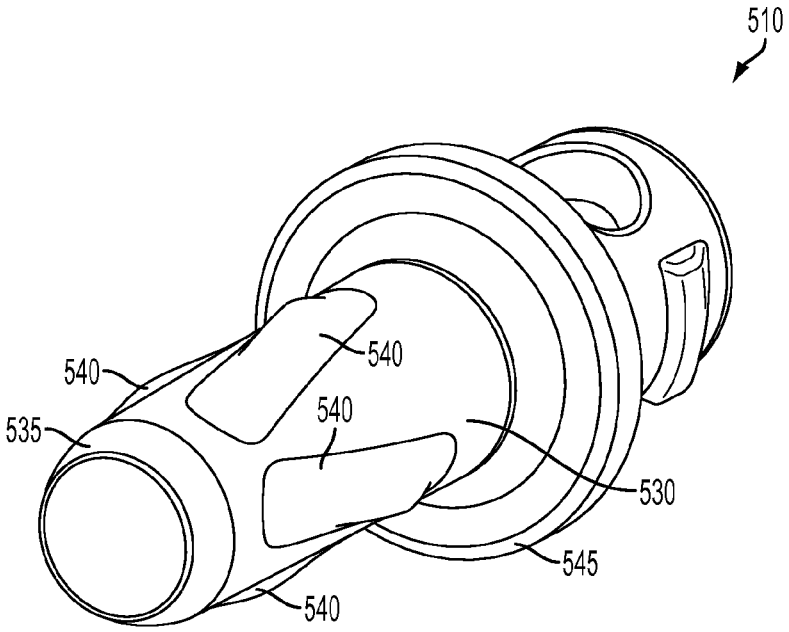
FIG. 5C is an exemplary perspective view of an embodiment of the self-centering nock of FIG. 5A.
Figure 5D:
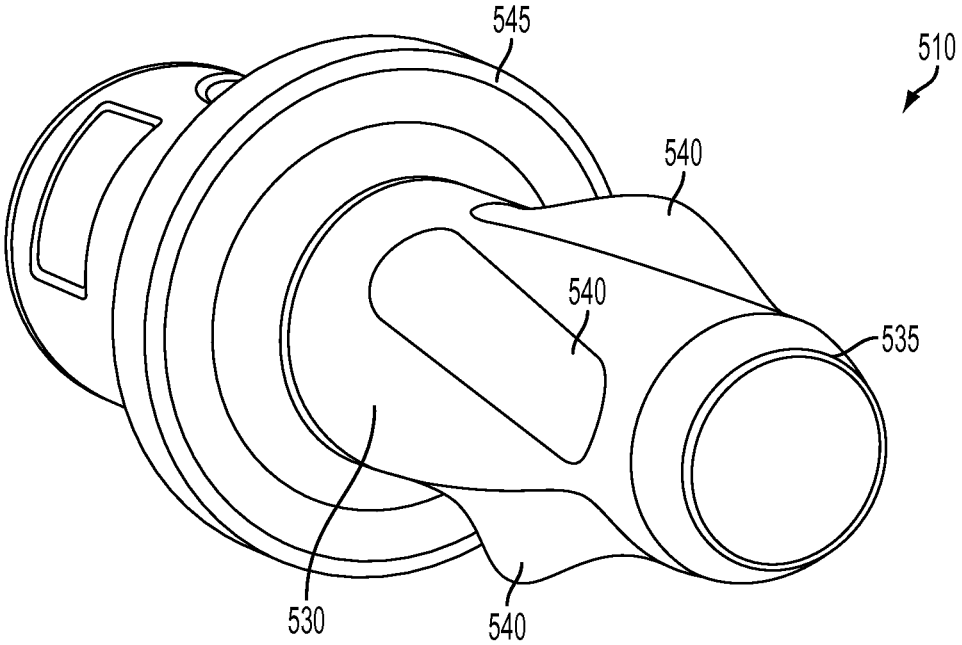
FIG. 5D is an exemplary frontal view of an embodiment of the self-centering nock of FIG. 5A.

As illustrated in FIG. 3, proximal end 20 and intermediate portion 30 of nock 10 are configured to be received into bore hole 90 of bolt 80. When so received, compression of compliant arms 40 of nock 10 by the inner surface of bore 90 of bolt 80 provides a friction fit that provides one way of attaching nock 10 to bolt 80. FIG. 4 illustrates compression of compliant arms 40 by the inner surface of bore 90 of bolt 80 as proximal end 20 and intermediate portion 30 of nock 10 are received by bore hole 90.

Because the friction fit attaching bolt 80 to nock 10 is provided by compression of compliant arms 40, the latter is preferably formed from a material that is elastic or viscoelastic. Such materials include, for example, elastic or viscoelastic polycarbonates, elastomers and rubber. In certain embodiments, compliant arms 40 may be formed from combinations of a material that is elastic and a material that is viscoelastic; in such embodiments, the elastic and viscoelastic parts of each compliant arm may be configured identically to those of the other compliant arms to permit uniform and symmetric compressibility of the compliant arms when nock 10 is attached to bolt 80.

The substantial rotational symmetry of compliant arms 40, for example, along cross-sectional planes normal to the main axis of the nock, permits the restoring forces of the compressed compliant arms 40 (when proximal end 20 and intermediate portion 30 of nock 10 are inserted within bore 90 of bolt 80) to apply symmetrically, thus tending to center proximal end 20 and intermediate portion 30 within bore 90 of bolt 80. Such self-centering permits the nock-bolt assembly to be well-balanced. For example, as is known and customary in the art, an experienced user or a person of ordinary skill in the art may spin a nock-bolt assembly around its main axis to determine whether the assembly is well-balanced. Advantages of a well-balanced nock-bolt assembly may include superior performance (e.g., flight) characteristics of the corresponding arrow or bolt product. Compliant arms (or, more generally as discussed below, projecting protrusions) may be said to be "substantially rotationally symmetric" when they are rotationally symmetric or nearly rotationally symmetric. This provides sufficient rotational symmetry of the compliant arms (or, more generally as discussed below, projecting protrusions) so that the nock-bolt assembly is well-balanced.

Because of the compressibility of compliant arms 40, nock 10 is capable of being received and properly self-centered as described within the bores of a plurality of differently dimensioned bolts. For example, nock 10 may be properly fitted in either of a first bolt and a second bolt, where the bore diameters of the first bolt and the second bolt are different. Table 1 below lists examples of differently dimensioned bolts that may each accommodate the nock so that the nock is self-centered and each bolt-nock assembly is well-balanced. As is seen based on Table 1, in the current embodiment, nock 10 may be properly used in differently dimensioned bolts, where the bore diameter of the bolts varies between 0.24 to 0.314 inches.

TABLE 1

Crossbow Bolt Dimensions

| Bolt | Outer Diameter (inches) | Inner Diameter (Inches) |
|---|---|---|
| Horton Bone crusher 20" | 0.345 | 0.24 |
| GT L4 | 0.346 | 0.272 |
| CE Crossbolt | 0.344 | 0.282 |
| Carbon Express maxima hunter | 0.34 | 0.283 |
| carbon express Surge 20" | 0.348 | 0.283 |
| CE Parker | 0.339 | 0.284 |
| CE Red Hot | 0.34 | 0.285 |
| Easton FMJ | 0.343 | 0.287 |
| Beman Carbon Thunderbolt | 0.346 | 0.296 |
| Barnett Headhunter | 0.347 | 0.296 |
| Easton Power Bolt | 0.345 | 0.297 |
| Easton 10Pt Pro Elite | 0.345 | 0.298 |
| GT L2 | 0.34 | 0.3 |
| GT L3 | 0.344 | 0.3 |
| Excalibur Carbon Firebolt | 0.349 | 0.3 |
| Horton Carbon Strike MX | 0.344 | 0.3 |
| Horton BC carbon 20" | 0.344 | 0.3 |
| Victory | 0.345 | 0.3 |
| Horton BC Alum 20" | 0.345 | 0.304 |
| Easton 10PT 2219 | 0.344 | 0.305 |
| Easton Magnum 2219 | 0.344 | 0.306 |
| carbon express Alum. 2219 20" | 0.348 | 0.306 |
| Horton Lightning Strike MX 20" | 0.35 | 0.312 |
| Easton Magnum 2216 | 0.346 | 0.314 |
| max | 0.35 | 0.314 |
| min | 0.339 | 0.24 |

Nock 10 may be designed to accommodate a greater or lesser variation in bore diameters and/or different bore diameter values, as the need may be, by changing the shape, number and geometry of compliant arms 40, and by changing the material (and elasticity and/or viscoelasticity) from which compliant arms 40 are formed. Accordingly, by varying such parameters, various nocks can be designed that are self-centered, and various well-balanced nock-bolt assemblies can be designed that are based on differently dimensioned bolts. The design, manufacture and use of a nock of a particular shape, composition and size for use with a plurality of differently dimensioned bolts may provide efficiencies based on economies of scale, and thus reduce expenses and time required to design, manufacture and/or market differently sized nocks adapted for use with correspondingly dimensioned bolts.

In practice, the nock 10 is constructed so that it is compatible with a large variation in the internal diameter of the bores 90 of bolts 80. In connection with the largest-diameter bores 90 of bolts 80 compatible with nock 10, compliant arms 40 should deform sufficiently to produce sufficient holding force via friction within the bore 90 of the bolt 80. In connection with the smallest-diameter bores 90 of bolts 80 compatible with nock 10, compliant arms 40 should be sufficiently compliant to allow for sufficient deformation to enable compliant arms 40 to compress to these smaller diameters without exceeding the ductility limit of the material from which compliant arms 40 are formed. Accordingly, appropriate combinations of ductile material and compliant structure can be selected for compliant arms 40. In one embodiment, the selection of a polymer material such as polycarbonate with a failure strain limit of over 100% for compliant arms 40 allows for a large variation in compliant structures. In one or more preferred embodiments, the maximum strain value will be less than 20% at the limiting location within the design.

Distal end 50 of nock 10 contains, at its distal end, opening 70 and groove 75 that are configured to receive the string of a bow or crossbow. Distal end 50 also includes button 60, which may be transparent to allow light produced within nock 10 to be transmitted outside through button 60. In embodiments in which nock 10 is a lighted nock, nock 10 may also include an internal power source such as a battery to power the internal lighting mechanism.

In certain embodiments, nocks 10 in accordance with the current invention may be sold to end users separately from the bolts 80 that are configured to properly accommodate the nocks 10. In these embodiments, the end user may fit the nock 10 within the bolt 80 bore, after purchasing each of these components.

In other embodiments, the manufacturer or distributor may fit the nocks 10 into differently dimensioned bolts 80, and may market the bolt-nock assemblies as a finished product. In aspects of these embodiments, the manufacturer or distributor may also use a thermoplastic adhesive such as hot-melt glue for more secure attachment of a self-centered nock 10 within a bolt 80. For example, the manufacturer or distributor may apply hot-melt glue to the outer surfaces of compliant arms 40 of nock 10, allow the glue to cool down, and then sell nock 10 to the end user. The end user may at a later time choose a bolt 80, for insertion of the nock 10. The user may then insert and properly fit nock 10 within bore 90 of bolt 80, and then heat the back end of bolt 80 (i.e., the end of bolt 80 at which the nock is located) to melt the hot-melt glue. Afterwards, once the hot-melt glue cools down, nock 10 would be securely attached to bolt 80, due to the bonding action of the hot-melt glue, which would act between the outer surfaces of compliant arms 40 and the internal surface of bore 90 of bolt 80. In other embodiments, the manufacturer or distributor may store stocks of nocks 10 with hot-melt glue applied as described above, and may, at times of its choosing, fit the nocks 10 into the bolts 80 using a heating process as just described before marketing bolt-nock assemblies to end users.

The nocks of embodiments of the present invention may be lighted, such as nock 10 of the embodiment of FIGS. 1-4. However, nocks that are not lighted may also be used in embodiments of the present invention.

As discussed, the embodiment of nock 10 illustrated in FIGS. 1-4 includes proximal end 20, intermediate portion 30 and distal end 50. These portions of nock 10 may include separate pieces that are assembled together, or may include a nock made from a single-formed piece, together with assembled components such as button 60 and compliant arms 40.

Injection molding may, for example, be used to manufacture portions of the nock 10 or a single-formed nock. Further, in certain embodiments, the nock 10 may consist of only an intermediate portion 90 (containing compliant arms 40) and distal end 50 (possibly containing button 60 as a component but not containing any compliant arms); in such embodiments, intermediate portion 90 and distal end 50 may be separately formed and assembled, or may be formed as a single-piece nock with components, such as button 60.

Nocks 10 in accordance with embodiments of the present invention may more generally include one or more projecting protrusions instead of only compliant arms 40 as described, which include a special case of a projecting protrusion. In embodiments in which projecting protrusions are used on a nock, substantial rotational symmetry of the projecting protrusions, for example along cross-sectional planes normal to the main axis of the nock, permits the restoring forces of the compressed projecting protrusions to apply symmetrically, thus tending to center the relevant nock portions within the bore 90 of a bolt 80. Preferred embodiments include those in which there are at least two such projecting protrusions, and more preferred embodiments include those in which there are at least three such projecting protrusions.

FIGS. 5A-D illustrate an embodiment of the present invention in which projecting protrusions, formed from elastomer ribs 540 that are co-molded on the rigid polymer substrate comprising intermediate portion 530 of nock 510, are present on nock 510. Elastomer ribs 540 are similar to compliant arms 40 of the embodiment of FIGS. 1-4 in that they are also compressible and elastic or viscoelastic (or configured from a combination of elastic and viscoelastic materials as described earlier).

When proximal end 520 and intermediate portion 530 of nock 510 are received within bore 590 of bolt 580, compression of elastomer ribs 540 of nock 510 by the inner surface of bore 590 of bolt 580 provides a friction fit that secures nock 510 to bolt 580. In the embodiment of FIGS. 5A-D, there are two pairs of co-molded ribs 540, with the ribs 540 of each pair cooperating with one another during insertion into bore 590 to carry out a wedging action that increases retention of the nock 510 within the bore 590 of bolt 580. The co-molded ribs 540 are situated on intermediate portion 530 so that they are substantially rotationally symmetric along planes normal to intermediate portion 530. In this embodiment, the elastomer ribs 540 are formed from a material that is sufficiently elastic and/or viscoelastic to provide a self-centered and well-balanced fit when nock 510 is fitted to bolts 580 having at least two different bore dimensions.

Figure 6:
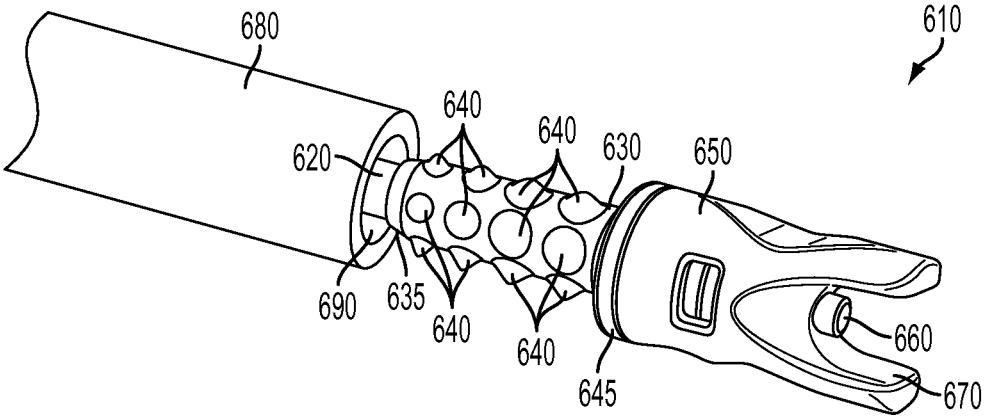
FIG. 6 is an exemplary perspective view of an embodiment of a self-centering nock that has projecting protrusions co-molded on a rigid polymer substrate, and which is illustrated as being partially inserted into the bore of a bolt.

FIG. 6 illustrates another embodiment comprising projecting protrusions 640 that are co-molded on intermediate portion 630 of nock 610. Projecting protrusions 640 are similar to compliant arms 40 of the embodiment of FIGS. 1-4 and the elastomer ribs 540 of the embodiment of FIGS. 5A-D in that they are also compressible and elastic and/or viscoelastic. When proximal end 620 and intermediate portion 630 of nock 610 are received within bore 690 of bolt 680, compression of projecting protrusions 640 of nock 610 by the inner surface of bore 690 of bolt 680 provides a friction fit that secures nock 610 to bolt 680. In this embodiment, the projecting protrusions 640 are formed from a material that is sufficiently elastic and/or viscoelastic to provide a self-centered and well-balanced fit when nock 610 is fitted to bolts having at least two different bore dimensions.

Figure 7A:
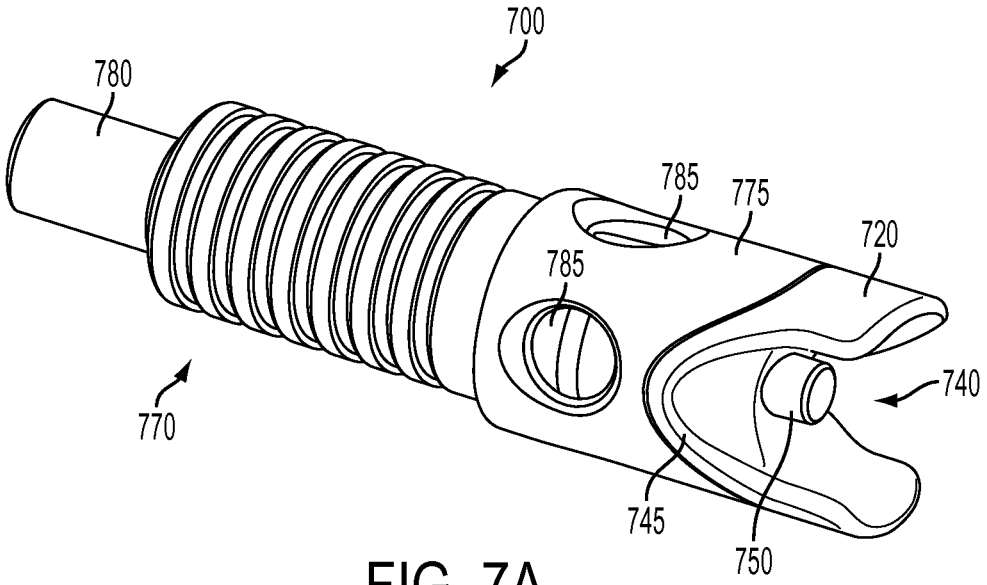
FIGS. 7A and 7B depict a crossbow "capture" style nock in accordance with an embodiment of the invention with ribs that are formed circumferentially about the primary axis.
Figure 7B:
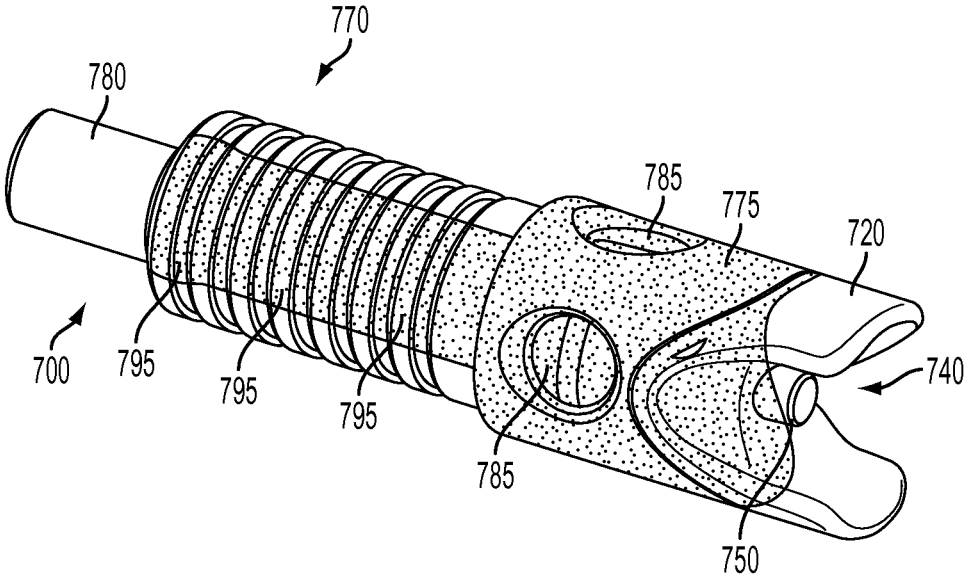

FIGS. 7A and 7B depict a crossbow "capture" style nock 700 in accordance with an embodiment of the invention. Nock 700 has components similar to those of nock 10 shown in FIG. 1, except that nock 700 includes structural support piece 775 that is attached to distal end 720 of nock 700, which contains a groove 745 that provides opening 740. Structural support piece 775 provides structural support for distal end 720, which is preferably made from a clear polymeric material or polycarbonate to allow the transmission of light from the light source of nock 700 to the outside. In certain embodiments, structural support piece 775 is made from an aluminum alloy, which in this embodiment has a yield strength of 75 ksi, which is much greater than the yield strength of the clear polymeric material in the distal end 720 of nock 700 that has an approximate yield strength of 9000 psi.

Structural support piece 775 may be constructed of or include other structural support materials such as Mg, Ti, Steel, Stainless Steel, and/or high strength, structural polymeric or composite materials. Typically, such structural support materials (including aluminum) are not transparent or translucent to light emissions from the light source (which may be an LED) of nock 700, which distinguishes them from the clear polymeric materials used in constructing distal end 720 of nock 700. Structural polymer materials that may be used to construct structural support piece 775 may include: nylon, delrin, carbon reinforced polymers, fiberglass reinforced polymers, PEEK, PMMA, and/or urethane. Additional polymers or composites serving the same purpose of supporting the less structurally robust clear polymeric piece in a lighted nock may be used in embodiments of the invention.

The groove 745 and opening 740 are configured to receive the string of a crossbow. Structural support piece 775 has a cylinder-like shape and substantially surrounds and structurally supports distal end 720. The distal end 720 of structural support piece 775 contains a groove 745 so that structural support piece 775 does not obstruct opening 740. In this embodiment, the distal end of structural support piece 775 contains four holes 785 (only two of which are visible in FIGS. 7A and 7B). All four holes 785 allow for light to escape from the nock. Other embodiments with different numbers of holes or semi-solid structures to allow light to escape may also be utilized.

In the embodiment of FIGS. 7A and 7B, one of the holes 785 permits access for turning off the light source within nock 700, and another hole 785 permits light to escape sideways from nock 700. The other two holes 785 are configured to allow structural support piece 775 to snap fit onto distal end 720 of nock 700. Distal end 720, in one aspect of this embodiment, contains protrusions configured to permit such a snap fit. Button 750 is configured to turn on the light source of the nock 700 when depressed (for example, depressed due to the tension of the bow string during operation). Button 750, may be transparent to allow light produced within nock 700 to be transmitted outside through button 750.

The distal end of structural support piece 775, which is cylindrically shaped and proximate the distal end 720 of nock 700, has a cross-sectional radius that is greater than that of the proximal end of structural support piece 775, as depicted in FIGS. 7A and 7B. The proximal end of structural support piece 775 is shaped and dimensioned so that it can receive the distal end of battery 780, which provides a power source for the light source (not depicted in FIGS. 7A and 7B) of nock 700. Intermediate portion 770 of nock 700 is configured to receive the proximal end of structural support piece 775. Intermediate portion 770 has a grooved surface 795 which is configured to compression fit into the bore of a conventional crossbow bolt. In addition, a distal end (closest to button 750) of the intermediate portion 770 can, for example, snap fit or friction fit into the distal end of structural support piece 775. Accordingly, in a preferred embodiment, the material of intermediate portion 770, including grooved surface 795, is elastic and/or viscoelastic so that intermediate portion 770 is able to snap fit as well and also provide a self-centered and well-balanced fit when nock 700 is fitted to bolts having at least two different bore dimensions. The intermediate portion 770 is preferably manufactured using a conventional injection molding technique, which generally allows for a more complex geometry than, for example, an extrusion process. As known, extrusion molding is a continuous process, whereas injection molding is not. Accordingly, extrusion molding is generally a more expensive manufacturing process for a given material and desired shape.

Figure 8:
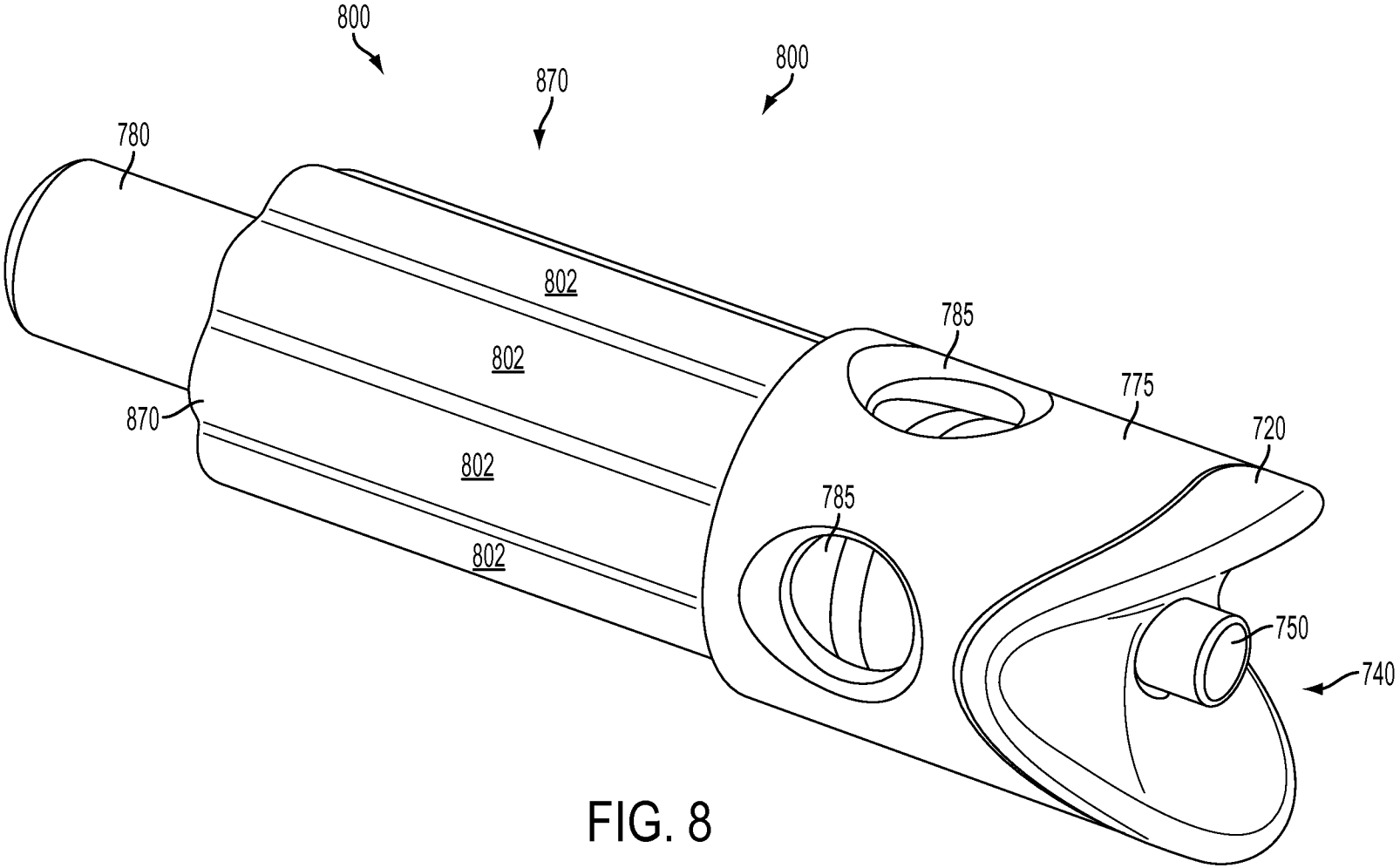
FIG. 8 depicts a crossbow "capture" style nock in accordance with an embodiment of the invention with ribs that are formed along the primary axis.

FIG. 8 depicts a crossbow "capture" style nock in accordance with an embodiment of the invention. FIG. 8 is very similar to the embodiment depicted in FIGS. 7A and 7B, except that the ribs 802 are formed along the primary axis of the nock 800. With the ribs 802 are formed along the primary axis of the nock 800, intermediate portion 870 (which corresponds to intermediate portion 770 in FIGS. 7A and 7B) can be readily manufactured using extrusion molding.

As will be appreciated, the embodiments shown in FIGS. 1-6 can also utilize and include structural support piece the same as or similar to the structural support piece 775 used in the embodiment of FIGS. 7A, 7B and 8. In addition, compliant arms, projecting protrusions, and/or projecting protrusions of any geometry that possesses substantial rotational symmetry as discussed may be used.

In a variation of the above embodiments, projecting protrusions are formed on the inner surface of the bore of the bolt, and are not formed on the on nock. In another variation, nocks may contain a bore into which the distal end of the bolt fits, with projecting protrusions either on the inner surface of the bore of the nock or on the distal end of the bolt. In these embodiments, the substantial rotational symmetry of the projecting protrusions along cross sections normal to the axis of the bolt provides a self-centering fit and a well-balanced bolt-nock assembly as discussed earlier.

Embodiments of the present invention have been described for the purpose of illustration. Persons skilled in the art will recognize from this description that the described embodiments are not limiting, and may be practiced with modifications and alterations limited only by the spirit and scope of the appended claims which are intended to cover such modifications and alterations, so as to afford broad protection to the various embodiments of invention and their equivalents.

Having thus described my invention, what I claim as new and desire to secure by Letters Patent is as follows:

1. A self-centering nock for partial insertion into a bore of a bolt, the self-centering nock comprising:

an intermediate portion composed of a rigid polymer substrate, wherein a plurality of compliant projecting protrusions composed of an elastic or viscoelastic material are co-molded onto the intermediate portion;

a proximal end contiguous with the intermediate portion; and a distal end contiguous with the intermediate portion, the distal end including an opening configured to receive the string of at least one of a bow and crossbow.

2. The self-centering nock of claim 1, wherein an inner diameter of the bore ranges between 0.24 inches to 0.314 inches.

3. The self-centering nock of claim 1, wherein there are four compliant projecting protrusions co-molded onto the intermediate portion.

4. The self-centering nock of claim 1, wherein the plurality of compliant projecting protrusions comprise ribs.

5. The self-centering nock of claim 4, wherein the ribs are compressible.

6. The self-centering nock of claim 1, wherein the elastic or viscoelastic material comprises a polycarbonate, an elastomer, or a rubber.

* * * * *